US007063120B2

(12) United States Patent
Huthmacher et al.

(10) Patent No.: US 7,063,120 B2
(45) Date of Patent: Jun. 20, 2006

(54) DISPENSER WITH COIL

(75) Inventors: Winfried Huthmacher, Frankfurt (DE); Georg Semmler, Wiesbaden (DE)

(73) Assignees: BIC Deutschland GmbH, Liederbach (DE); Societe BIC, Cedex (FR)

( * ) Notice: Subject to any disclaimer, the term of this patent is extended or adjusted under 35 U.S.C. 154(b) by 270 days.

(21) Appl. No.: 10/226,227

(22) Filed: Aug. 23, 2002

(65) Prior Publication Data

US 2003/0015299 A1 Jan. 23, 2003

Related U.S. Application Data

(63) Continuation of application No. PCT/EP01/02031, filed on Feb. 22, 2001.

(30) Foreign Application Priority Data

Feb. 25, 2000 (EP) ..... 00103986

(51) Int. Cl.
*B32B 31/00* (2006.01)

(52) U.S. Cl. ..... 156/577; 242/160.2; 242/588.3; 242/588.6; 206/411; 118/76

(58) Field of Classification Search ..... 156/523, 156/577, 579, 574, 527, 238, 538, 540; 118/76, 118/200, 257, 25; 206/411; 242/170, 171, 242/160.2, 160.4, 588, 588.2, 588.3, 588.6
See application file for complete search history.

(56) References Cited

U.S. PATENT DOCUMENTS

| | | | | |
|---|---|---|---|---|
| 5,346,580 | A * | 9/1994 | Elges et al. | 156/540 |
| 5,772,840 | A * | 6/1998 | Morinaga | 156/540 |
| 5,897,742 | A * | 4/1999 | Semmler | 156/577 |
| 6,112,796 | A * | 9/2000 | Stevens | 156/577 |
| 6,145,770 | A * | 11/2000 | Manusch et al. | 242/422.4 |
| 6,273,169 | B1 * | 8/2001 | Ono et al. | 156/540 |
| 6,363,990 | B1 * | 4/2002 | Kozaki | 156/540 |
| 6,453,969 | B1 * | 9/2002 | Ferrara | 156/577 |
| 6,499,524 | B1 * | 12/2002 | Miller et al. | 156/577 |
| 6,500,259 | B1 * | 12/2002 | Tamai et al. | 118/76 |
| 6,601,632 | B1 * | 8/2003 | Bouveresse et al. | 156/577 |
| 6,675,856 | B1 * | 1/2004 | Kozaki | 156/577 |

FOREIGN PATENT DOCUMENTS

| | | |
|---|---|---|
| DE | 40 39 683 | 6/1992 |
| DE | 42 17 294 | 12/1993 |
| WO | WO 97/12827 | 4/1997 |

* cited by examiner

*Primary Examiner*—Mark A. Osele
(74) *Attorney, Agent, or Firm*—Jones Day

(57) ABSTRACT

A hand-held dispenser for applying a tape on a substrate surface, a casing for a supply reel for the tape, a take-up reel, and an application member for applying the tape. The tape is fed from the supply reel to the application member and then back to the take-up reel. The take-up reel and the supply reel are provided separately from each other. The supply reel and the take-up reel are elongated reels. At least the take-up reel includes at least two spaced apart reel members.

37 Claims, 5 Drawing Sheets

DISPENSER WITH COIL

CROSS-REFERENCE TO RELATED APPLICATIONS

The present application is a continuation of U.S. National Stage designation of co-pending International Patent Application PCT/EP01/02031, filed on Feb. 22, 2001, which claims priority to European Patent Application 00 103 986.6, filed Feb. 20, 2000. The entire content of both these applications is expressly incorporated herein by reference thereto.

FIELD OF THE INVENTION

The invention relates to a dispenser for applying a film or a tape, particularly a correction tape, on a substrate surface.

BACKGROUND OF THE INVENTION

Generally when using tape dispensers, a coating composition to be laid down onto a substrate surface is supplied on a carrier ribbon. During use of the dispenser, the correction tape is transferred onto the substrate surface as a continuous strip while the carrier ribbon is retained by the dispenser.

Hand-held devices for applying a film or a correction tape on a surface (alternately referenced herein as a tape dispenser for the sake of convenience without any intent to limit) typically comprise separate supply and take-up reels provided within a casing of a dispenser, and the two reels are linked by a drive mechanism as well as a clutch mechanism. Due to the size of the reels, considerable space is required within the casing of the dispenser. This is in contrast to the general trend towards slim elongated pen-shaped dispensers.

A tape dispenser as shown in FIGS. 11 and 12 is known from WO 97/12827. According to this known dispenser, the ends of the carrier ribbon are spliced together so that the ribbon is a continuous loop and the tape is wound in several super-imposed layers around the pair of spaced equal-diameter reel members thereby forming an oval reel of tape. The oval reel is accommodated in an elongate casing of general slim configuration. A section of tape between the inner and outermost windings of the reels is arranged to extend out of the casing and over an applicator head or tip which is used to press the tape against the substrate surface when using the dispenser. Two reel members are respectively carried for independent rotation about their respective axes. When the tape is pressed against the substrate surface by means of the tip edge and the tip is moved over the surface in a direction substantially perpendicular to the edge, the correction tape is transferred to the surface from the carrier ribbon and is laid down as a continuous strip. Fresh tape is drawn from the supply reel and is drawn from the innermost winding of the reel at the rearmost reel. To assist the separation of the tape from the reel, the reel is preferably given a profile so that it displaces the innermost winding out of the plane of the reel. The separated tape passes over the forwardmost reel and to guide rollers before traveling onto the applicator head. As the tape is delivered from the innermost winding of the oval reel, the outer layers move inwardly and some slippage occurs between the adjacent layers. The friction between the slipping layers can be used to ensure the tension needed in the tape to control the portion extending around the applicator head.

The known reel arrangement as shown in FIGS. 11 and 12 has an advantage because the amount of tape held in the oval reel is substantially greater than would be stored in the same number of layers around a single cylindrical reel. However, this oval reel arrangement inherently has the disadvantage that the different layers on the reel are increasingly squeezed together onto each other when using the dispenser. This is due to the fact that a certain rewound length of tape is always fed back on a diameter which is substantially larger than the diameter from which fresh tape is drawn to the applicator head. Due to the squeezing effect, the different layers wound on the reel are wound tighter and tighter on the reel. The thus resulting friction between the layers is substantially increased, and once the friction has exceeded a certain limit, it is no longer possible to use the dispenser without breaking the tape.

In the tape dispenser described in DE 40 39 683, the manual device has a casing with an elongated shape and the supply reel is pressed together into an elongated shape and the backing tape is drawn back into a space within the casing.

A design similar to the design described above is provided in a tape dispenser according to DE 42 17 294. In this known dispenser, the supply reel is pressed together into an elongated shape and the backing tape is wound up onto a take-up reel placed behind the supply reel.

In view of the above prior art, it would be desirable to provide a dispenser for applying a tape on a substrate surface, wherein the dimensions of the casing of the dispenser should be reduced to an elongated shape without encountering the problems known from WO 97/12827.

SUMMARY OF THE INVENTION

The present invention provides a preferably hand-held dispenser for applying a tape or film on a substrate surface. The dispenser comprises a housing for a stock in the form of an essentially flattened reel of tape and a rewound length of tape. The tape is fed from the stock to an application member for applying the tape on a surface and then back into the housing around two deviation members. These deviation members are spaced apart from each other and arranged separate from the supply reel.

At least one of the deviation members can be mounted fixedly on a base plate. Alternatively, all of the deviation members can be mounted rotatably.

A carrier belt can be wound around the at least two deviation members such that the tape can be wound in successive layers on the carrier belt.

A drive-mechanism and a clutch can be provided between a rotatable deviation member for the stock and a rotatable deviation member for the rewound length of the tape.

The stock of the tape and the rewound length of the tape can be aligned one behind the other in the housing.

At least one deviation member for the rewound length of the tape and at least one deviation member for the stock of the tape can be arranged on a common axis.

The common axis can comprise the drive mechanism.

The diameter of the deviation member for the rewound length of the tape can be different from the diameter of the deviation member for the stock of the tape.

The application member can be mounted on a base plate which carries the deviation members.

The application member can be an integral part of the base plate.

The application member can be rigid against torsion and flexion relative to the base plate.

The base plate can be mounted elastically in the housing such that the base plate (and the optionally integrated application member) can perform a torsion and/or flexion movement relative to the housing.

The base plate can be mounted on the housing by means of mounting parts which are flexible due to the material they are made of and/or due to their shape.

The application member can be made from a plastic material different from the plastic material of the base plate.

Both the take-up reel and the supply reel can each have at least two reel members, wherein the distance of the reel members of the take-up reel can be different from the distance of the reel members of the supply reel.

The diameter of the reel members of the take-up reel can be different from the diameter of the reel members of the supply reel.

BRIEF DESCRIPTION OF THE DRAWINGS

The detailed description will be better understood in conjunction with the accompanying drawings, wherein like reference characters represent like elements, as follows.

DETAILED DESCRIPTION OF THE INVENTION

Figure 1:
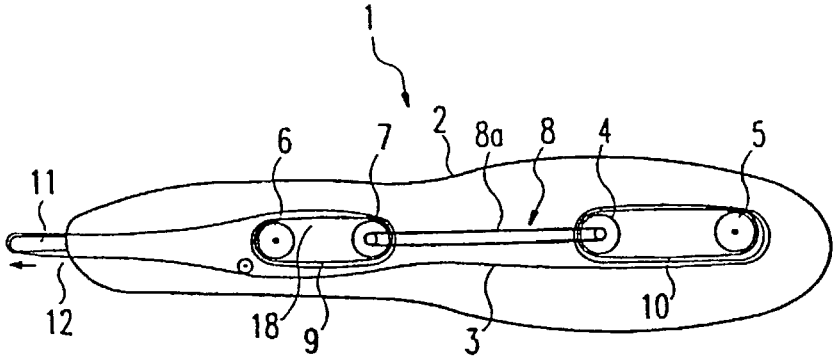
FIG. 1 is a side elevational view of an embodiment of a device (with the casing in cross-section), formed in accordance with principles of the present invention whereby all reel members are mounted on the same side of the mounting structure, one behind the other.

Embodiments of the invention are described below by referring to the drawings. Exemplary tape dispensers formed in accordance with the principles of the present invention are illustrated in FIG. 1 through FIG. 10, in which the same reference numbers refer to similar constituent components or elements.

With reference to FIG. 1, at first the general features of an embodiment of a hand-held dispenser 1 according to the present invention will be explained. The hand-held dispenser 1 comprises a casing 2 in which a take-up reel 9 and a supply reel 10 are housed. Both take-up reel 9 and supply reel 10 comprise spaced apart and independently rotatable tape deviation elements or reel members (referenced herein as "reel member(s)" for the sake of convenience without any intent to limit) 6, 7 and 4, 5, respectively. A tape 3, particularly a correction tape, is wound around reel members 4, 5 of supply reel 10 and then fed to an application head or member 11 (referenced herein as an "application member" for the sake of convenience without any intent to limit) extending from an aperture 12 of casing 2. Application member 11 is configured to be pressed against an application surface during use of device 1.

From application member 11, the used tape 3 (usually the backing tape without the deposited coating) is fed to take-up reel 9 where it is wound around reel members 6, 7.

Between take-up reel 9 and supply reel 10, a drive and clutch mechanism 8 is provided such that take-up reel 9 has the tendency to take-up more length of tape 3 than is supplied by supply reel 10.

In the embodiment of FIG. 1, drive and clutch mechanism 8 is schematically depicted as an elastic tape or band 8*a* consisting of rubber or synthetic material or plastic.

Figure 2:
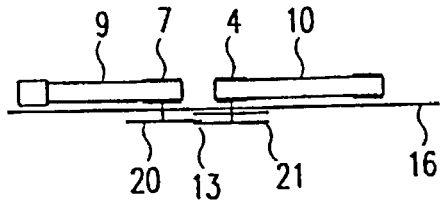
FIG. 2 is a top view of an embodiment of a device similar to that of FIG. 1, but showing a different drive mechanism between the two reels.

FIG. 2 shows another possibility for a realization of a drive and clutch mechanism 13. The drive and clutch mechanism 13 links the two reels 9, 10 so that as tape is drawn for use from supply reel 10, take-up reel 9 is rotated to wind up the used carrier ribbon of tape 3. As the rotation speeds of the reels are not the same, a sliding clutch mechanism is also integrated in mechanism 13. As can be seen in FIG. 2, according to this embodiment, one reel member 7 of take-up reel 9 is linked to one reel member 4 of supply reel 10 by mechanism 13. A first friction disk 20 engages with a fork-like second friction disk 21, wherein first friction disk 20 is fixed in rotation against reel member 7 of take-up reel 9 and second friction disk 21 is fixed in rotation against reel member 4 of supply reel 10. Such a clutch and drive mechanism is principally known from DE-A-198 16 925 and therefore, for further details, reference is made to said document.

Note that any other drive/clutch mechanism, such as for example a gear mechanism and a clutch between the hub and the reel carrier, can be used in connection with the present invention.

In the embodiment according to FIG. 2, take-up reel 9 and supply reel 10 are mounted on mounting structure 16 aligned one behind the other, wherein take-up reel 9 is arranged more forwardly than supply reel 10 in casing 2.

Figure 3:
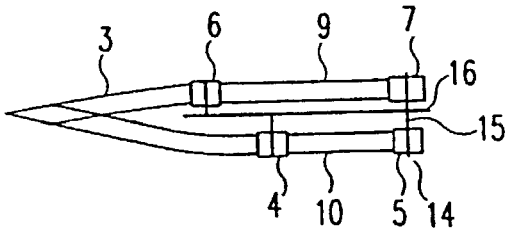
FIG. 3 is a further embodiment of the present invention, whereby the reels are arranged one behind the other.

In contrast thereto, according to the embodiment of FIG. 3, two reels 9 and 10 are arranged such that they are essentially one aside or beside the other. According to this embodiment, reel member 7 of take-up reel 9 is arranged on the same common axis 15 as reel member 5 of supply reel 10. The common axis 15 represents the drive mechanism for the two reels 9, 10. For example, reel member 7 of take-up reel 9 can be rotatably fixed with respect to axis 15, whereas between common axis 15 and reel member 5 of supply reel 10, a sliding clutch 14 can be integrated.

Furthermore, it is to be noted from FIG. 3 that the distance between reel members 6, 7 of take-up reel 9 is larger than the distance between reel members 4 and 5 of supply reel 10.

Figure 4:
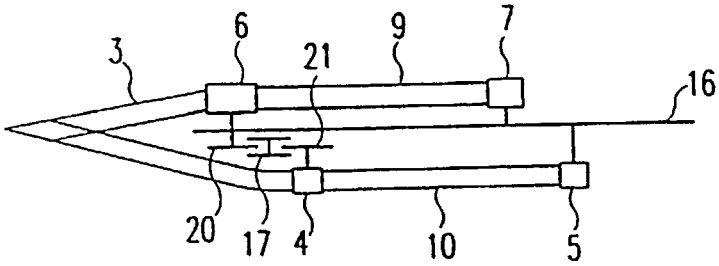
FIG. 4 is a still further embodiment of the present invention.

FIG. 4 shows a further embodiment of the present invention. As in the embodiments of FIGS. 2 and 3, also according to this embodiment of FIG. 4, all reel members 4, 5, 6, and 7 are mounted on one mounting structure 16.

The drive mechanism of FIG. 4 is build up by a first friction disk 20, an intermediate forked disk 17, and a second friction disk 21.

Figure 5:
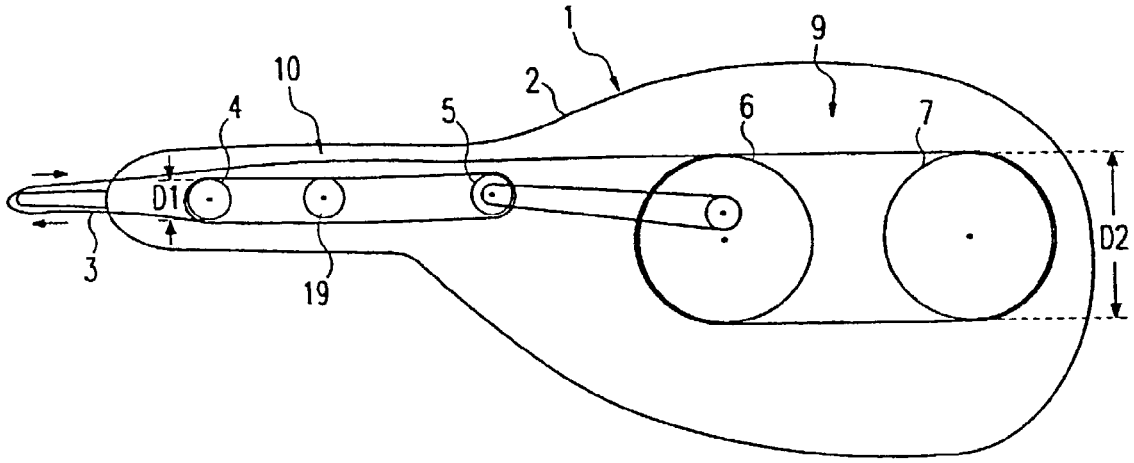
FIG. 5 is an embodiment of the present invention according to which the reel members of the reels have different diameters and distances from each other.

FIG. 5 shows a still further embodiment of the present invention. According to this embodiment the take-up reel 9 comprises two independent reel members 6, 7. The supply reel 10 comprises three independent reel members 4, 5, and 19. Furthermore, according to this embodiment not only is the distance between reel members 6 and 7 of take-up reel 9 different from the distance between reel members 4, 5 of supply reel 10, but also the diameter D2 of the reel members 6, 7 of take-up reel 9 is larger than the diameter D1 of reel members 4, 5 of supply reel 10. Therefore, take-up reel 9 has the tendency to take up more length of tape 3 as it is supplied at the same time by supply reel 10. This effect can be compensated for by a clutch mechanism provided anywhere between the supplied and the rewound length of tape 3. For example, a clutch function in its simplest realization can be provided by a controlled slip of tape 3 relative to one of the reel members.

Due to the fact that diameter D2 of reel members 6, 7 of take-up reel 9 is set to be larger than diameter D1 of reel members 4, 5, 19 of supply reel 10, the outer shape of casing 2 of hand-held dispenser device 1 of FIG. 5 can be shaped like a pen.

Figure 6A:
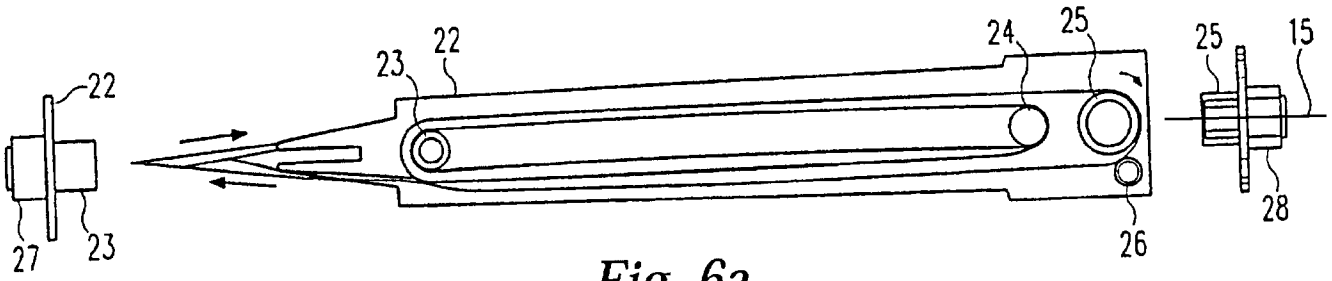
FIGS. 6*a* to 6*c* are details of still another embodiment of the present invention according to which some of the tape deviation elements are mounted on a base plate.

With reference to FIGS. 6*a,* 6*b,* and 6*c,* further modifications of an embodiment of the present invention will be explained.

As can be seen from FIGS. 6*a,* 6*b,* and 6*c* within the housing of the device, a base plate 22 is provided carrying deviation elements 23, 24, 25, 27, and 28. The deviation elements can either be fixed in rotation (23, 24, 27) or they can be mounted rotatably on base plate 22, as is the case for first and second rotating tape deviation elements 25 and 28. Note that the expression "deviation element" according to the present invention relates to any structural element or means which can provide for a function of deviating the tape at least about 180°. Therefore, any ridges, recesses, pins, or extensions can be used for providing either the stock of tape 3 to be fed to the application member (shown in FIG. 6*a*) or for the rewound length of tape 3. According to the embodiment of FIG. 6*a*, the stock of tape 3 is wound in layers around two fixed pin-like distal and proximal tape deviation elements 23, 24. The tape 3 is guided around a first rotating tape deviation element 25 and then to the application member which is only shown symbolically in FIG. 6*a*. To be more precise, tape 3 is guided between first rotating tape deviation element 25 and a pinch roller 26. Therefore, when applying tape 3 on a substrate surface, first rotating tape deviation element 25 will be driven due to the friction which is predetermined by the pinch force effected by pinch roller 26. Therefore, by driving first rotating tape deviation element 25, a further second rotating tape deviation element 28 provided on the other side of base plate 22 is driven. The second rotating tape deviation element 28 is one of the tape deviation elements for rewinding the applied length of correction tape 3. Therefore, the drive mechanism according to the embodiment of FIG. 6*a* is constituted by first and second rotating tape deviation elements 25, 28. Note that a clutch mechanism can be provided in the common axis 15 connecting first and second rotating tape deviation elements 25, 28. Alternatively the clutch mechanism can be omitted and the clutch effect can be present by providing a predetermined slip between tape 3 and first rotating tape deviation element 25 (by adjusting the pinching force of pinch roller 26) and/or a predetermined slip of the rewound tape on the circumference surface of second rotating tape deviation element 28.

Therefore the drive mechanism comprising the clutch and coils can be constituted by only the three following parts. Base plate 22 with the fixed tape deviation elements 23, 24, 27, and first and second rotating tape deviation elements 25, 28.

Figure 6B:
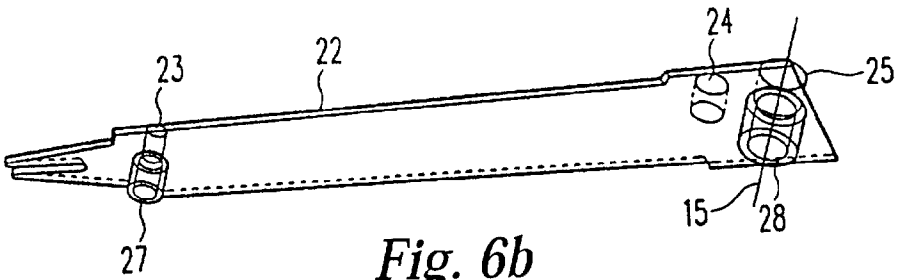

FIG. 6*b* shows a different view of an embodiment similar to the embodiment of FIG. 6*a*. Note that according to the modification of FIG. 6*b*, pinch roller 26 has been omitted.

Figure 6C:
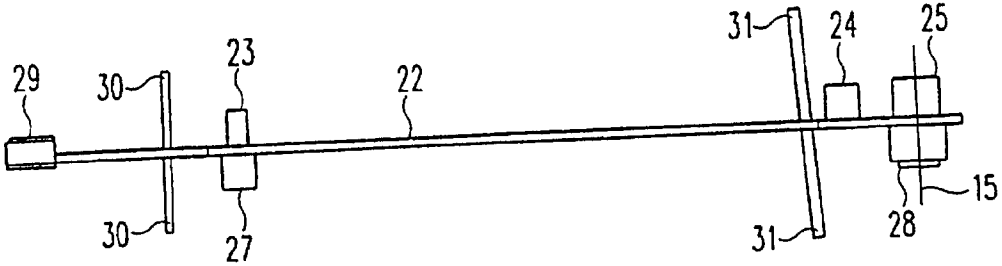

FIG. 6*c* shows a further modification of the embodiments of FIGS. 6*a* and 6*b*. According to this modification, application member 29 is fixed to base plate 22 and can be an integral part of base plate 22. Furthermore, in FIG. 6*c*, fixed tape deviation elements 23, 24, and 27, as well as first and second rotating tape deviation elements 25 and 28, are shown.

Application member 29 can either be molded of the same plastic material as the rest of base plate 22 or of a different plastic material. Particularly, application member 29 can be mounted rigidly, regarding flexion and torsion, to base plate 22. A compensation effect for an inclined application of application member 29 can be provided by elastically mounting base plate 22 (comprising the entire clutch, drive, coil, and application mechanism) inside casing 2 (not shown) of device 1. This can, for example, be effected by flexible distal and proximal mounting parts 30, 31 as shown schematically in FIG. 6*c*.

According to this modification, the whole internal mechanism of the device is suspended elastically against rotation and/or flexion inside casing 2 of device 1. Note that this modification can also be achieved by using coils known from the prior art instead of deviation elements shown in FIG. 6*c*. The essential part of the modification of FIG. 6*c* is that, to summarize, the whole internal mechanism comprising tape 3 (the stock and the rewound length of tape 3), the drive/clutch mechanism, and application member 29 are mounted rigidly with each other and are suspended elastically within casing 2 of hand-held correction device 1.

Therefore, according to the present invention, an elongated and pen-shaped or marker-like hand-held dispenser can be provided without encountering the problems of the prior art.

In all the exemplified embodiments described in the foregoing, it is an advantage to wind a carrier belt 18 around the preferably cylindrical or hollow-cylindrical deviation elements 6, 7 or 27, 28, as suggested in FIGS. 1 to 5. Carrier belt 18 is wound around appertaining deviation elements 4, 5, 27, 28 at a light but sufficient tension, so that in cases in which at least one of the preferably cylindrical or hollow-cylindrical deviation elements 6, 7, 27, 28 is rotatably mounted and is driven by a drive mechanism, for example, by first rotating tape deviation member 25 driven by tape 3, or on account of the frictional force effective between first rotating tape deviation member 25 and pinch roller 26, there is a drive connection between the driven first rotating tape deviation member, for example first deviation member 25, and carrier belt 18. The carrier belt 18 is preferably a flat belt, for example, made of a synthetic material such as plastic material or rubber. The at least one layer of the rewound length of tape 3 is provided at a preferably flat external side of carrier belt 18 (FIG. 7) and fixedly connected with carrier belt 18 by frictional force or a special connection. The connection can be brought about, for example, by an adhesive connection between the free end portion of the rewound length and the outer surface of carrier belt 18. A frictional connection between the rewound length and carrier belt 18 is achieved if the rewound length is wound around carrier belt 18 more than once.

Figure 7:
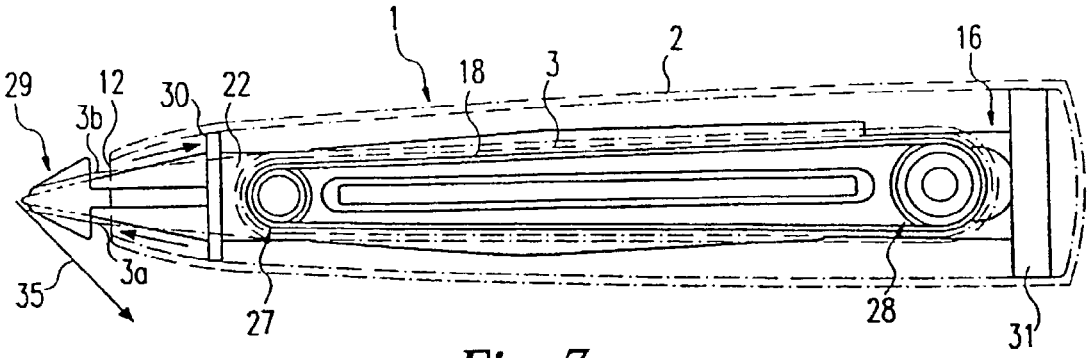
FIG. 7 is a still further embodiment of the present invention.
Figure 8:
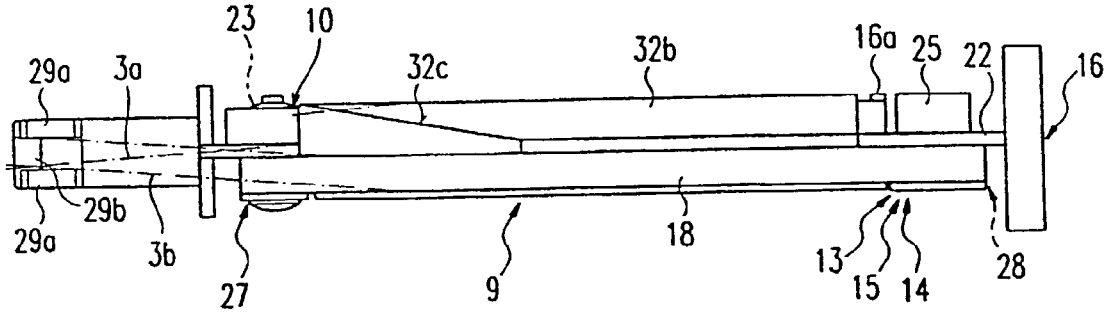
FIG. 8 is a bottom view of the application side of the hand-held device of FIG. 7.
Figure 9:
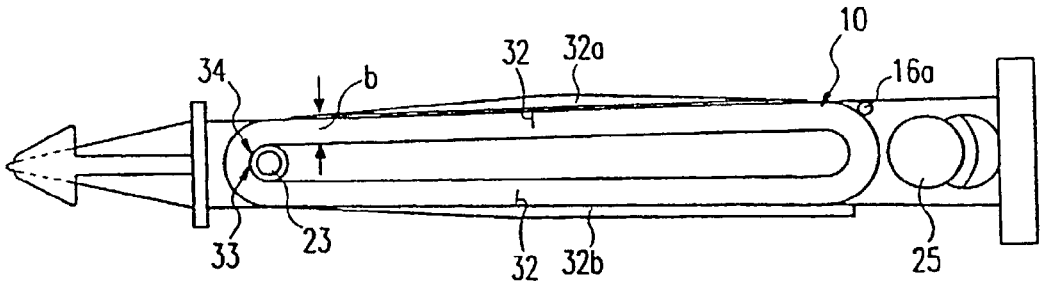
FIG. 9 is a side elevational view of the other side of the hand-held device according to FIG. 7.

In the exemplified embodiment according to FIGS. 7 to 10, the same or similar parts are given the same reference numbers. Elongated or essentially flattened take-up and supply reels 9, 10 are provided at both sides of mounting structure 16 or base plate 22. Supply reel 10 only consists of layers of tape 3 wound one above the other, and is positioned in the elongated form between first boundary surfaces 32 facing each other and extending parallel to the axes of rotation of reels 9, 10 in their transverse direction. For positioning flattened take-up and supply reels 9, 10 in their longitudinal direction, at least one second boundary surface 33 extending transverse to first boundary surface 32 and transverse to the longitudinal direction of elongated casing 2 can be provided, which is adjacent to outer or inner curve 34 of supply reel 10. In the modification according to FIGS. 7 to 10, second boundary surface 33, extending transversely, is constituted by distal fixed deviation element 23, which is rounded at least on its front side and which, in the modification, is formed by a cylindrical bearing pin which is mounted fixedly or rotatably around its axis on mounting structure 16 or base plate 22. The proximal fixed deviation element 24 of the embodiment of FIGS. 6*a*, 6*b*, and 6*c* is not provided. The cross-sectional dimensions of distal fixed deviation element 23 are large enough for supply reel 10 having a ring width b to fit between proximal fixed deviation element 23 and first boundary surface 32. In this case, the outer curve of distal fixed deviation element 23 is adapted to the inner curve of the adjacent end of supply reel 10, whereby an optimum deviation surface is formed. As can be gathered from FIG. 9, first boundary surfaces 32 can be arranged rearwards, i.e., towards the rear side, away from application member 29, in a somewhat divergent fashion. As a result thereof, supply reel 10 is also given a somewhat rearwards divergent shape. First boundary surface 32 can be arranged at the sides of two strips 32*a*, 32*b* facing each other and projecting from mounting structure 16 or 22 towards the side of supply reel 10. As depicted in FIG. 9, at least lower strip 32*b* or both strips 32*a*, 32*b* can be shaped in the front end portion in a manner convergent enough to result in a rounded edge 32*c* extending forwards at the outer surface in a convergent fashion, said edge 32*c* improving the acute-angled course (FIG. 8) of tape sections 3*a*, 3*b*.

When tape 3 is pulled from the back of supply reel 10, a transversely directed second boundary surface 33 is not required in the rear end portion of supply reel 10 for limitation of supply reel 10, since this limitation function is fully complied with by second boundary surface 33 at the front end of supply reel 10. This means a limitation of supply reel 10 in its longitudinal direction is required only at that end of the reel that faces in the direction opposite the pulling direction, which will be described further below.

As already described in connection with the exemplified embodiments according to FIGS. 1 to 6, it is true also for the exemplified embodiment according to FIGS. 7 to 10 that take-up reel 9 is formed by carrier belt 18 which is wound around preferably cylindrical distal fixed deviation element 27 and second rotating cylindrical deviation element 28, of which second rotating tape deviation element 28 or both deviation elements 27, 28 is/are rotatably mounted around their central axis at mounting structure 16 or base plate 22. In this modification, too, the cross-section of second rotating tape deviation element 28 is dimensioned to be somewhat larger than the cross-section of first rotating tape deviation element 25, which is rotatably mounted on mounting structure 16 or base plate 22 at the side facing second rotating tape deviation element 28 and is rotatably connected with second rotating tape deviation element 28, is arranged preferably co-axially therewith, and can be connected by a common rotary shaft. The full reel 10 can extend to the vicinity of first rotating tape deviation element 25.

In all the exemplified embodiments, the deviation elements which are rotatably mounted can be constituted by a hollow-cylindrical sleeve, which is rotatably mounted on an associated cylindrical bearing pin.

As illustrated especially by FIGS. 6*b*, 6*c*, and 8, distal fixed tape deviation elements 23, 27 are arranged co-axially at the opposing sides of mounting structure 16 or 22 in the exemplified embodiments concerned. This is not absolutely necessary. The distal fixed tape deviation elements 23, 27 can be transverse to their central axes or offset against each other in the longitudinal direction of dispenser 1.

Figure 10:
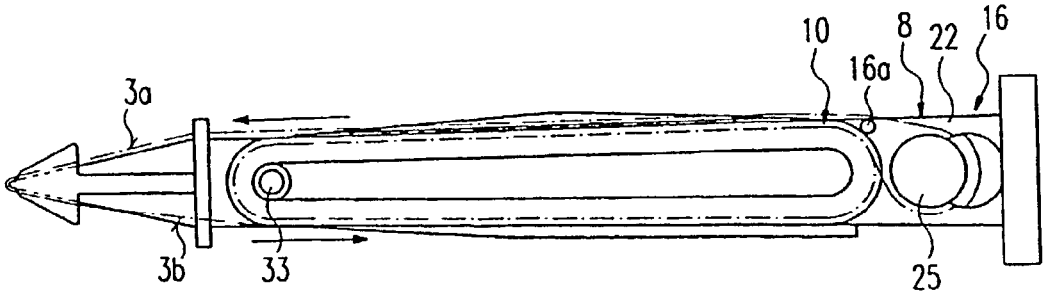
FIG. 10 is a side view according to FIG. 9 supplemented with a tape.
Figure 11:
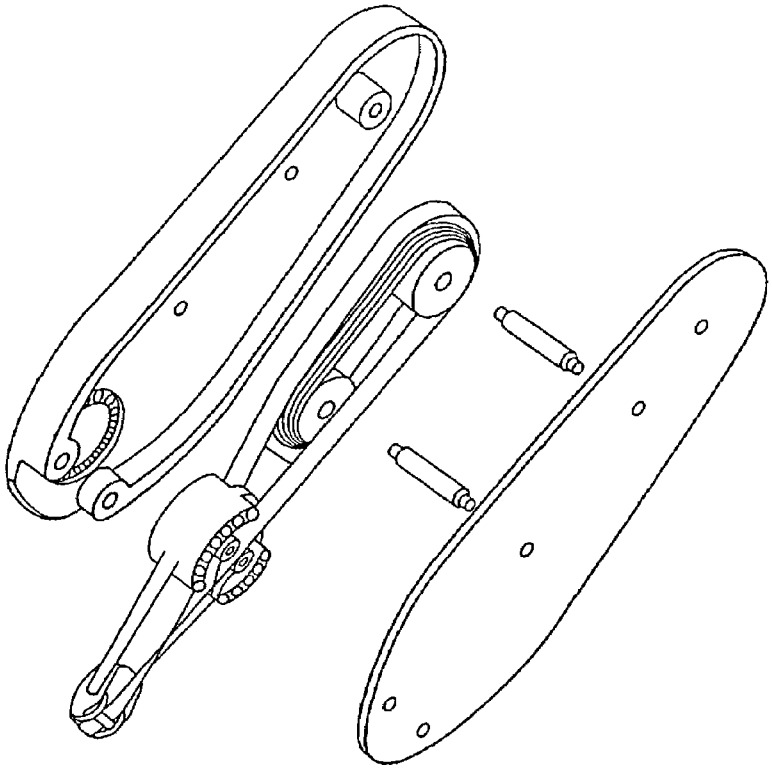
Fig. 11 (Prior Art)
FIGS. 11 and 12 are hand-held dispensers and an oval reel, respectively, according to the prior art.
Figure 12:
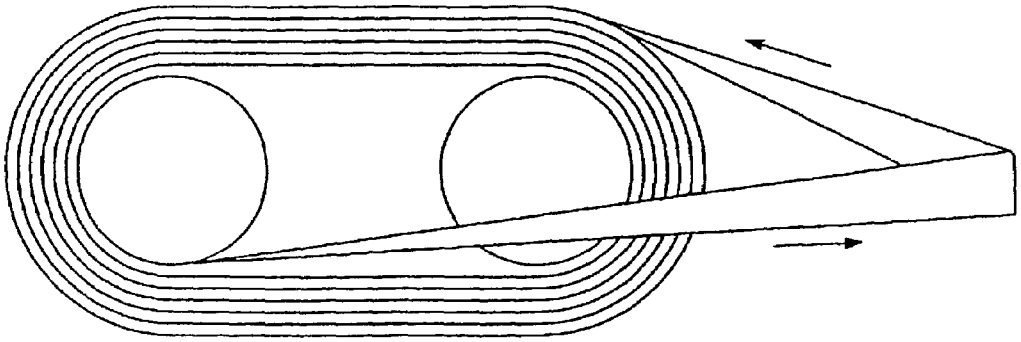
Fig. 12 (Prior Art)

In FIGS. 7 and 10, the direction of motion of tape 3 during operation is represented by a dash-dotted line. When placing application member 29 on a substrate and moving dispenser 1 in the direction illustrated by arrow 35 when pressing application member 11 against the substrate, lower tape section 3*a* extending towards application member 11 is moved in a direction towards application member 11 and, in doing so, is pulled from the lower (in FIG. 10 upper) ring portion of supply reel 10, wherein tape section 3*a* is wound around first rotating tape deviation member 25 by about 180° or more and thus causes second rotating tape deviation member 28 to rotate, too. Thereby first rotating tape deviation member 25 and carrier belt 18 disposed thereon are caused to rotate, whereby upper tape section 3*b* connected with carrier belt 18 is wound on carrier belt 18. Since the winding diameter of carrier belt 18 is larger than the effective diameter of first rotating tape deviation element 25, the thus generated drive mechanism for take-up reel 9 is tempted to move tape section 3*b* at a higher speed than the speed of tape section 3*a*. Since a sliding clutch 14 is integrated in this drive mechanism, for example, between first and second rotating tape deviation elements 25, 28 or between first rotating tape deviation element 25 and tape 3, the higher drive speed does not have any effect, with tape sections 3*a*, 3*b* always being subject to a certain tensile stress predetermined by the friction of sliding clutch 14, whereby looping is avoided. The tape section 3*a* extending from deviation element 25 to application member 29 is diverted around a rounded diverting pin 16*a* projecting from mounting structure 16 or base plate 22 and, as a result thereof, spaced apart from supply reel 10 or relieved from any pressure. The tape sections 3*a*, 3*b* extend—in a top view as shown in FIG. 8—at an acute angle from the one side to the other side of mounting structure 16 or base plate 22.

In comparison with the exemplified embodiment according to FIG. 6*a*, the turning drive connection between tape 3 and first rotating tape deviation element 25 is improved in the exemplified embodiment according to FIG. 10, because the winding angle is larger, namely greater than 180°.

As illustrated by FIGS. 7 to 10, distal and proximal mounting parts 30, 31 can be formed by a disk, whose peripheral shape conforms, e.g., to the round inner peripheral shape of casing 2. The size of the disk can be adapted to the inner size of casing 2 such that distal and proximal mounting parts 30, 31 position mounting structure 16 or base plate 22 in casing 2 in a radial fashion and preferably also in an axial fashion. Casing 2 can consist of two casing parts, for example two casing shells, whose divisional joint extends in or parallel to the longitudinal central axis of mounting structure 16 or base plate 22 or transversely thereto. In the latter case, it is advantageous to form casing 2 from a sleeve-shaped part into which mounting structure 16 can be inserted from the back with reels 9, 10 as prefabricated components and which can be closed by the second part of casing 2 having the form of a lid.

As can be gathered particularly from FIG. 7, application member 29 preferably extends like a cross-web in its width to distal mounting part 30. Application member 29 can be designed to be in one piece therewith. As a result thereof, stability is ensured for application member 29. In the front end portion of application member 29, guiding webs 29*a* project on both sides downwards and upwards in a manner known per se, said guiding webs limiting between themselves a lower and an upper guide groove 29*b* for tape 3.

List of reference signs

| | | | |
|---|---|---|---|
| 1 | hand-held device | 27 | fixed tape deviation element |
| 2 | casing | 28 | second rotating tape deviation element |
| 3 | tape | 29 | application member |
| 3a | tape section | 29a | guiding web |
| 3b | tape section | 29b | guide groove |
| 4 | rotating tape deviation element (reel member) | 30 | distal flexible mounting parts |
| 5 | rotating tape deviation element (reel member) | 31 | proximal flexible mounting parts |
| 6 | rotating tape deviation element (reel member) | 32 | first boundary surface |
| 7 | rotating tape deviation element (reel member) | 33 | second boundary surface |
| 8 | drive mechanism | 34 | outer or inner curve |
| 8a | elastic band | 35 | arrow |
| 9 | take-up reel | D1, D2 | diameter of reel members |
| 10 | supply reel | | |
| 11 | application member | | |
| 12 | aperture | | |
| 13 | drive and clutch mechanism | | |
| 14 | sliding clutch | | |
| 15 | common axis (drive mechanism) | | |
| 16 | mounting structure | | |
| 16a | diverting pin | | |
| 17 | intermediate wheel | | |
| 18 | carrier belt | | |
| 19 | third reel member | | |
| 20 | first friction disc | | |
| 21 | second friction disc | | |
| 22 | base plate | | |
| 23 | distal fixed tape deviation element | | |
| 24 | proximal fixed tape deviation element | | |
| 25 | first rotating tape deviation element | | |
| 26 | pinch roller | | |

What is claimed is:

1. A dispenser for applying a tape on an application surface, said dispenser comprising:

a casing;

an application member extending from said casing;

a supply reel within said casing; and an elongated take-up reel within said casing and comprising at least two tape deviation members spaced apart from each other to form an elongated reel of used tape and arranged separate from said supply reel.

2. A dispenser according to claim 1, wherein said supply reel comprises at least two deviation members.

3. A dispenser according to claim 2, wherein a diameter of said at least two deviation members of said take-up reel is different from a diameter of said at least two deviation members of said supply reel.

4. A dispenser according to claim 2, wherein all of said deviation members are rotatably mounted.

5. A dispenser according claim 4, wherein a drive and clutch mechanism is provided between at least one deviation member of said supply reel and at least one deviation member of said take-up reel.

6. A dispenser according to claim 2, wherein a carrier belt is wound around said at least two deviation members of said take-up reel.

7. A dispenser according to claim 6, wherein a carrier belt is wound around said at least two deviation members of said supply reel.

8. A dispenser according claim 2, further comprising a mounting structure, wherein said supply reel and said take-up reel are arranged at opposite sides of said mounting structure.

9. A dispenser according to claim 8, wherein at least one of said at least two deviation members of said take-up reel and at least one of said at least two deviation members of said supply reel are arranged on a common axis.

10. A dispenser according to claim 8, wherein said common axis includes a drive mechanism.

11. A dispenser according to claim 2, further comprising a base plate, wherein at least one of said deviation members is fixed on said base plate.

12. A dispenser according to claim 11, wherein said application member and said base plate are made from different materials.

13. A dispenser according to claim 11, wherein said application member is mounted on said base plate.

14. A dispenser according to claim 13, wherein said application member is an integral part of said base plate.

15. A dispenser according to claim 13, wherein said application member is rigid against at least one of torsion and flexion relative to said base plate.

16. A dispenser according to claim to 11, wherein said base plate is mounted elastically in said casing such that said base plate can perform at least one of torsion and flexion movement relative to said casing.

17. A dispenser according to claim 16, wherein said base plate is mounted in said casing by means of mounting parts which are flexible due to the material they are made of.

18. A dispenser according to claim 16, wherein said base plate is mounted in said casing by means of mounting parts which are flexible due to their shape.

19. A dispenser according to claim 1, wherein said supply reel and said take-up reel are aligned one behind the other in said casing.

20. A dispenser according to claim 1, wherein said supply reel is mounted with one end on only one of said at least one of said at least two deviation members.

21. A dispenser according to claim 1, wherein said supply reel is mounted with a front end on only one of said at least two deviation members.

22. A dispenser according to claim 1, wherein said at least two deviation members of said take-up reel are rotatable.

23. A dispenser according to claim 1, wherein said at least two deviation members of said take-up reel are fixedly mounted.

24. A dispenser according to claim 1, wherein a carrier belt is wound around said at least two deviation members of said take-up reel.

25. A dispenser according to claim 1, further comprising a tape having a stock portion extending from said supply reel onto said application surface and a rewound portion extending from said application surface, into said casing onto said take-up reel.

26. A dispenser for applying tape on an application surface, said dispenser comprising:

a casing;

an application member extending from said casing;

a supply reel within said casing; and a base plate elastically mounted to said casing;

wherein:

said application member and at least one of said supply reel and said take-up reel are mounted on said base plate; and said base plate is mounted for elastic movement while in an application position with said application member extending from said casing in an application position ready to apply tape on a surface surface.

27. A dispenser according to claim 26, wherein said application member is an integral part of said base plate.

28. A dispenser according to claim 26, wherein said base plate is mounted elastically in said casing such that said base plate can perform at least one of torsion and flexion movement relative to said casing.

29. A dispenser according to claim 26, wherein said base plate is mounted in said casing by means of mounting parts which are flexible due to the material they are made of.

30. A dispenser according to claim 26, wherein said base plate is mounted in said casing by means of mounting parts which are flexible due to their shape.

31. A dispenser for applying tape on an application surface, said dispenser comprising:

a casing;

an application member extending form said casting;

a take-up reel within said casing, an elongated supply reel within said casing and comprising at least two tape deviation members spaced apart from each other to form an elongated supply of tape and arranged separate from said take-up reel.

32. A dispenser according to claim 31, wherein a carrier belt is wound around said at least two deviation members of said supply reel.

33. A dispenser according to claim 31, wherein said take-up reel comprises at least two deviation members spaced apart from each other and arranged separate from said supply reel.

34. A dispenser according to claim 33, wherein all of said deviation members are rotatably mounted.

35. A dispenser according to claim 34, wherein a carrier belt is wound around said at least two deviation members of said take-up reel and said supply reel.

36. A dispenser for applying a tape on an application surface, said dispenser comprising:

a casing;

an application member extending from said casing;

a supply reel within said casing; and a take-up reel within said casing and comprising at least two deviation members spaced apart from each other, arranged separate from said supply reel, and movable independently from each other.

37. A dispenser for applying tape on an application surface, said dispenser comprising:

a casing;

an application member extending from said casing;

a take-up reel within said casing;

a supply reel within said casing and comprising at least two deviation members spaced apart from each other, arranged separate from said take-up reel, and movable independently from each other.

* * * * *